United States Patent [19]

Kato

[11] 4,189,148

[45] Feb. 19, 1980

[54] TOWED TARGET SHIP WITH SUBMERGED HULL

[75] Inventor: Shigeru Kato, Kamakura, Japan

[73] Assignee: Japan Aircraft Mfg. Co., Ltd., Yokohama, Japan

[21] Appl. No.: 857,977

[22] Filed: Dec. 6, 1977

[30] Foreign Application Priority Data

Dec. 8, 1976 [JP] Japan ..... 51/163858[U]

[51] Int. Cl.[2] ..... F41J 9/06

[52] U.S. Cl. ..... 273/350; 114/245; 114/313; 273/359

[58] Field of Search ..... 273/105.2; 114/244, 114/245, 313; 272/1 B

[56] References Cited

U.S. PATENT DOCUMENTS

| | | | |
|---|---|---|---|
| 1,444,491 | 2/1923 | Baldwin | 273/105.2 |
| 2,164,340 | 7/1939 | Morgan et al. | 273/105.2 |
| 2,524,863 | 10/1950 | White | 114/244 |
| 3,024,757 | 3/1962 | Aschinger | 114/244 |
| 3,092,858 | 6/1963 | Wallach | 272/1 B |
| 3,440,992 | 4/1969 | Chance | 114/245 |
| 3,613,097 | 10/1971 | Daughenbaugh | 273/105.2 |
| 3,760,761 | 9/1973 | Umazume | 114/244 |
| 3,868,920 | 3/1975 | Schirtzinger | 114/332 |

FOREIGN PATENT DOCUMENTS

| | | | |
|---|---|---|---|
| 892351 | 2/1972 | Canada | 114/244 |
| 149606 | 9/1931 | Switzerland | 114/274 |
| 508974 | 7/1939 | United Kingdom | 273/105.2 |
| 509001 | 7/1939 | United Kingdom | 273/105.2 |

*Primary Examiner*—Richard C. Pinkham
*Assistant Examiner*—Lawrence E. Anderson
*Attorney, Agent, or Firm*—Frishauf, Holtz, Goodman and Woodward

[57] ABSTRACT

A target ship includes a hull travelling at a predetermined depth below the water level, and a pair of poles between which a target is attached, the target being disposed above the water level.

4 Claims, 6 Drawing Figures

TOWED TARGET SHIP WITH SUBMERGED HULL

BACKGROUND OF THE INVENTION

This invention relates to a target ship for shooting drill or practice.

As a target ship for shooting drill on shooting drill waters, a catamaran type hull 1 (see FIG. 1) adapted to be towed by a mother carrier is known in which support poles 2 are vertically mounted on the hull and a target 3 is attached between the support poles 2. Since, however, the hull 1 is floated on the water level, if it is towed at fast speed, it tends to be upset under the influence of waves. For this reason, the hull can not be towed not only at a speed of about 10 knots, but also in stormy weather. Furthermore, there is a risk that the hull will be injured or damaged by bullets during shooting drill or practice.

SUMMARY OF THE INVENTION

It is accordingly the object of this invention to provide a target ship whose hull travels completely submerged below the water level to prevent it from being injured or damaged by bullets or from being upset by waves to permit it to travel not only at high speed, but also in stormy weather.

PREFERRED EMBODIMENT OF THE INVENTION

Figure 1:
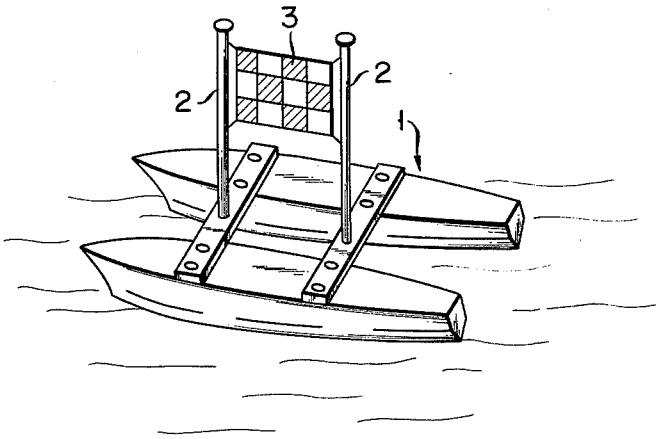
FIG. 1 PRIOR ART
FIG. 1 is a perspective view showing a conventional target ship.
Figure 2:
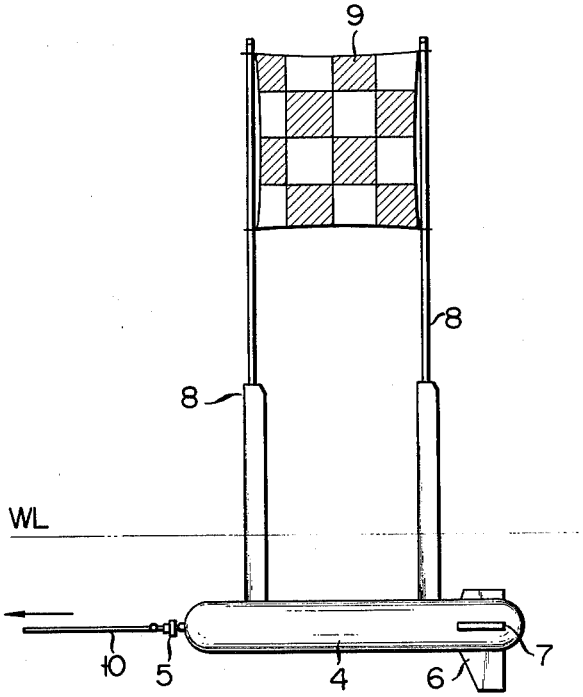
FIGS. 2 and 3 are side and front views, respectively, showing one embodiment of this invention.
Figure 3:
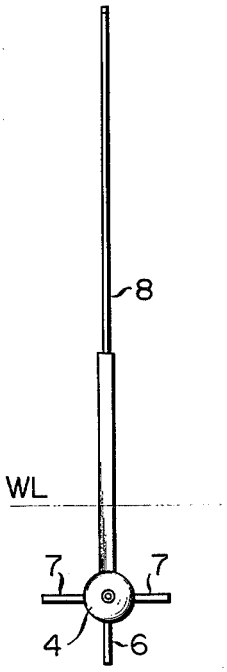

In FIGS. 2 and 3 reference numeral 4 shows a streamlined hull. The hull 4 comprises a metal outer shell of closed structure and foamed resin filled into the outer shell. The hull 4 has a towing rope connector 5 attached at the forward end and has a vertical stabilizing blade 6 and horizontal stabilizing blades 7 attached at the rear end portion. Reference numeral 8 shows a pair of upright support poles vertically mounted one ahead of the other on a center line on the hull 4 with a distance left therebetween. Reference numeral 9 is a target removably attached between the two support poles 8. The target is made of a plate or a blind (cloth). The hull 4 is so designed so that it travels at a predetermined depth (about few meters) below the water level WL. The support poles 8 are high up above the water level WL during the travelling of the hull.

Such a target ship is on board the mother ship and carried to the shooting drill waters where it is unloaded from the mother ship after the target 9 is attached to the support poles. Then a towing rope 10 is connected to the towing line connector 5. A floating rope is used as the towing line and the target ship is towed by mother ship with a distance of about 1200 to 3600 m left between the mother ship and the target ship. The target ship is towed to travel in a straight line with a predetermined depth held by the action of the stabilizing blades 6 and 7 at a predetermined depth below the water level WL. The target 9 on the support poles on the target ship flutters about normally above the water level WL.

Figure 4:
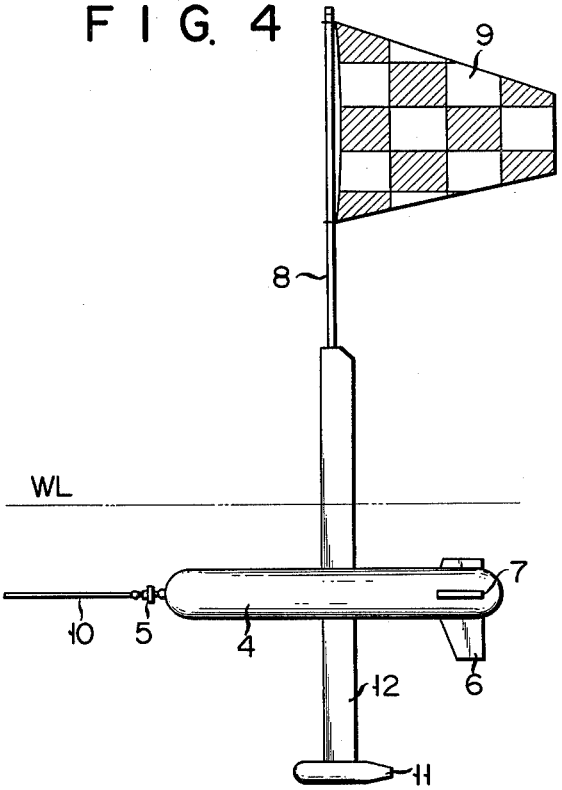
FIGS. 4 and 5 are side and front views, respectively showing a modification of FIGS. 2 and 3.
Figure 5:
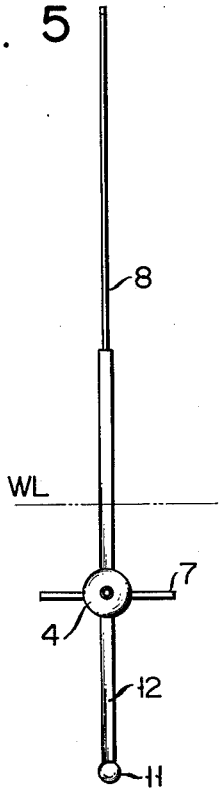
Figure 6:
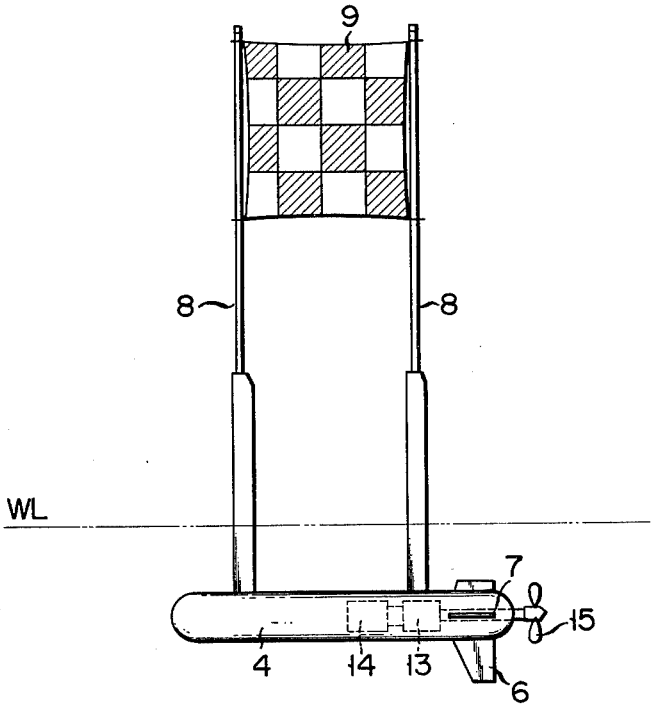
FIG. 6 is a side view showing another embodiment of this invention.

Although in the above-mentioned embodiment two support poles 8 are mounted on the target ship, one support pole may be attached to the target ship. In this case, the support pole 8 is vertically secured to the target ship, as shown in FIGS. 4 and 5, at the middle of the hull 4 with the target 9 attached thereto. While in the above-mentioned embodiment the target ship 4 is stably supported only by the stabilizing blades 6 and 7, a ballast weight 11 may be suspended, by a support leg 12, from under the hull 4, as shown in FIGS. 4 and 5. When during towing the support leg 12 receives a resistance, the hull 4 tends to be further submerged. However, if a resistance received by the support pole 8 is balanced by the resistance received by the support leg 12, the depth of the hull 4 is stabilized. Therefore, it is only necessary that the length of the support leg 12 be so determined as to match the desired depth of travelling of the hull. The target ship may be of a self-propelling type. In this case, a motor or an engine 13 and its power source 14, such as a battery, are installed in the hull 4 as shown in FIG. 6 and a propeller 15 is mounted on the stern of the hull for self-propulsion. In the installation of the engine the support pole is constructed as a funnel through which suction and exhaust are effected. The vertical stabilizing blade 6 and horizontal stabilizing blade 7 can be mounted such that they can be angularly adjusted on the hull 4. If an angular adjusting defice for the blades 6 and 7 which is mounted in the hull 4 is controlled by a radio frequency from the mother carrier, it is possible to arbitrarily control the travelling course and depth of the hull 4. In this case, it is convenient to mount an antenna on the support pole. The angular adjusting device may be controlled by a controller which is installed in the hull 4 and which has a travelling course program etc. stored therein. A depth gauge may be mounted in the hull 4 and in this case the horizontal stabilizing blade is swung by a combination of the depth gauge and controller.

Since the hull of the target ship according to this invention travels below the water level, the ship can be prevented from being injured or damaged by bullets and it can be long used merely by replacing a damaged target with a new one. In consequence, a great saving in costs can be attained. Since the target ship is not upset due to the swelling of waves, it can travels in a manner to assume a stable posture. The ship can be stably towed not only at high speeds, but also in stormy weather.

What is claimed is:

1. A target ship comprising:

a hull designed to travel at a predetermined depth below a water level and completely submerged in the water;

a towing line connector on said hull for connection to a mother ship via a towing line;

target support means mounted on said hull and extending substantially upright from said hull substantially above the water level, said target support means including a pair of spaced apart upwardly extending poles; and a replaceable bullet penetrable target mounted in a substantially vertical plane between said spaced apart poles of said support means substantially above the water level, said target being spaced a substantial vertical distance above said submerged hull and water level;

said hull including vertical and horizontal stabilizing blades extending therefrom to maintain said hull at a predetermined depth below the water level when it travels regardless of whether the target is penetrated.

2. A target ship according to claim 1 wherein said vertical and horizontal stabilizing blades extend from the rear side portion of said hull.

3. A target ship according to claim 1 wherein said towing line connector is connected to the front of said hull, and wherein said vertical and horizontal stabilizing blades extend from the rear side portion of said hull.

4. A target ship according to claim wherein said hull comprises a closed metal outer shell; and foamed resin filled in said outer shell.

* * * * *